US008517526B2

(12) United States Patent
O'Keeffe et al.

(10) Patent No.: US 8,517,526 B2
(45) Date of Patent: Aug. 27, 2013

(54) PRINT CARTRIDGE

(75) Inventors: Declan O'Keeffe, Kildare Letxtip (IE); Patrick Lynch, Lucan Dublin (IE); Darren Hackett, Dublin (IE)

(73) Assignee: Hewlett-Packard Development Company, L.P., Houston, TX (US)

( * ) Notice: Subject to any disclaimer, the term of this patent is extended or adjusted under 35 U.S.C. 154(b) by 344 days.

(21) Appl. No.: 12/595,917

(22) PCT Filed: Apr. 25, 2008

(86) PCT No.: PCT/US2008/061631

§ 371 (c)(1), (2), (4) Date: Oct. 14, 2009

(87) PCT Pub. No.: WO2008/134552

PCT Pub. Date: Nov. 6, 2008

(65) Prior Publication Data

US 2010/0128095 A1 May 27, 2010

(30) Foreign Application Priority Data

Apr. 30, 2007 (GB) ..... 0708266.2

(51) Int. Cl.
*B41J 2/175* (2006.01)

(52) U.S. Cl.
USPC ..... 347/87

(58) Field of Classification Search
USPC ..... 347/85, 86, 87
See application file for complete search history.

(56) References Cited

U.S. PATENT DOCUMENTS

| | | | | |
|---|---|---|---|---|
| 5,280,299 | A * | 1/1994 | Saikawa et al. | 347/87 |
| 5,671,001 | A * | 9/1997 | Elliot et al. | 347/87 |
| 5,784,088 | A * | 7/1998 | Ujita et al. | 347/86 |
| 5,790,157 | A | 8/1998 | Higuma et al. | |
| 6,474,796 | B1 * | 11/2002 | Ishinaga | 347/85 |
| 6,773,097 | B2 * | 8/2004 | Dowell | 347/85 |
| 7,360,881 | B2 * | 4/2008 | Hagen et al. | 347/86 |
| 2002/0041313 | A1 | 4/2002 | Koitabashi et al. | |
| 2007/0008389 | A1 | 1/2007 | Hagen et al. | |

OTHER PUBLICATIONS

International Search Report and the Written Opinion of the International Searching Authority. Mail date Jul. 25, 2008. International application No. PCT/US2008/061631, international filed Apr. 25, 2008.

* cited by examiner

*Primary Examiner* — Anh T. N. Vo

(57) ABSTRACT

A print cartridge comprises an ink housing 500 having at least one interior compartment 110 with a print head mounted at the base of the housing in fluid communication with the compartment via a passageway 180 having an entrance above the bottom of the compartment. A compressed foam block 300 substantially fills the compartment above the passageway entrance so as to leave a free space laterally adjacent to the passageway. A rib 198 extends upwardly along one wall of the compartment from the free space partially to the top of the foam block, the foam block not conforming fully to the cross-section of the rib to leave an air vent channel along at least one side of the rib.

9 Claims, 6 Drawing Sheets

PRINT CARTRIDGE

The present invention relates to a print cartridge.

U.S. Pat. No. 6,851,800 discloses a colour print cartridge for a desktop ink jet printer. As shown in FIG. 1, the cartridge comprises a housing 100 whose interior is divided by partitions 150, 152 into three compartments (or ink reservoirs) 106, 108 and 110, each for containing a different colored ink. In FIG. 1, compartments 106 and 108 are located side-by-side across the rear of the housing while compartment 110 extends across the full width of the front of the housing (in the present specification top, bottom, front, rear and like expressions refer to the orientation of the cartridge shown in the drawings).

A print head die 160 is attached to the base of the print cartridge housing 100. The print head 160 includes slots which align with outlet ports 120, 130 and 140 in the base of the housing 100. The bottom of the compartment 106 includes an exit port 170 that opens into a cavity 172 of the housing 100 to provide fluid communication between the interior of the compartment 106 and the print head 160 via the outlet port 130. Similarly, the compartment 110 is in fluid communication with the print head 160 via a cavity 182 and the outlet port 140, FIG. 2, and the compartment 110 is in fluid communication with the print head 160 via a cavity (not shown but similar to cavities 172, 182) and the outlet port 120.

A duct (or standpipe) 174 located within the compartment 106 is connected to the exit port 170, FIG. 1. The entrance to the standpipe 174 is above the bottom of the compartment 106. The standpipe 174 constitutes the only exit from the compartment 106 to the print head 160. Similar standpipes 178, 180 for compartments 108, 110 respectively can be seen in FIG. 2, each having an entrance above the bottom of the respective compartment and constituting the only exit from the compartment to the print head 160. Respective filters (not shown) are fitted over the entrance to each standpipe.

In order to charge the cartridge with ink, a respective foam block (not shown in FIGS. 1 and 2) is pre-compressed and push fitted into each compartment 106, 108, 110. Each block is generally rectangular and conforms closely to the side walls of the respective compartment. The bottom surface of each block sits on top of a respective standpipe filter and defines a free space (herein referred to as a snout region) laterally adjacent each standpipe at the bottom of each compartment. In FIG. 2 the snout regions for compartments 108, 110 are indicated by numerals 188, 190 respectively.

Before charging the cartridge, a lid 166, FIG. 3, is fitted to the top of the housing 100. Within the lid 166 at least one hole (not shown) is formed in register with each compartment. The cartridge is subjected to a vacuum with air being drawn downwardly through the compartments from the base of the housing through their respective standpipes. Respective ink dispensing needles (not shown in FIGS. 1 and 2) are introduced through the holes in the lid into the body of the foam blocks filling the compartments. Typically, the foam employed is polyurethane which is hydrophobic when dry. Ink dispensed by the needles is therefore forced into the foam and the ink expands isotropically outwardly and downwardly within the foam until the ink meets an outside surface of the foam block. Typically, the ink will first meet the underside of the foam block above the standpipe at which time the ink will tend to be drawn into and fill the standpipe and associated cavity. Thereafter, the ink settles and spreads out in the compartment and, if enough ink is injected, will ultimately meet the internal sidewalls of the compartment as well as fill the snout region.

Once the ink has been dispensed, the needles are withdrawn, and the cartridge is removed from the vacuum. The holes in the lid may be covered, for example with a label, although they should not be sealed so that they can act as air vents to allow ink to be drawn downwardly from the compartments during use of the cartridge.

Recently, there has been a demand to supply ink cartridges of a given format (i.e. exterior size and shape) with varying levels of ink capacity. So, for example, more intense printer users may wish to purchase high capacity cartridges for their printer, whereas low use users may wish to purchase low capacity cartridges for the same model of printer. Clearly, each of these cartridges needs to be of the same format to be compatible with the printer.

It has been found that cartridges of the type shown in FIGS. 1 and 2 are capable of being filled with relatively low levels of ink (of the order of 1 ml per compartment) or to be fully charged with ink (of the order of 8 ml per compartment).

A problem arises, however, if such cartridges are to be charged with intermediate levels of ink. After being charged to an intermediate level the vacuum is withdrawn from the cartridge. This normally occurs before the ink has settled within the compartment, and in particular before it has formed a generally horizontal air seal around the internal sidewalls of the compartment which normally first occurs within the foam block above the snout region. Thus, when the ink does finally settle, the horizontal air seal may trap air at atmospheric pressure in the snout region of the cartridge.

Cartridges such as this may be employed in many different environments and it has been found that if they are used, for example at altitude, air at normal atmospheric pressure trapped in the snout region tends to expand. As the foam holding the ink is hydrophobic, the foam tends not to accommodate this expansion and this can force ink out of the compartments through the cavities and the print head resulting in "drool". This problem does not occur for a low capacity fill, since in that case not enough ink is injected to meet the internal walls of the compartment and therefore any air in the snout region can escape upwardly through the foam block. In the case of a high capacity fill, although air may be trapped in the snout region, it is at low pressure (and hence less likely to drool at altitude) since the vacuum is maintained beyond the point at which a horizontal seal is made by the ink meeting the sidewalls of the compartment.

Referring now to FIG. 4 in conjunction with FIG. 3, there is shown in cross-section along the line B-B of FIG. 3, a variation 400 of the print cartridge of FIG. 1. The problem of cartridges charged to intermediate levels drooling has been addressed for the compartment 110 by providing a vent rib 192 extending upwardly along one wall of the compartment from the snout region 190 substantially to the lid 166, i.e. substantially the full height of the foam block 300. When the foam block 300 is pushed into the compartment 110, it cannot fully conform to the cross-section of the rib 192 on the wall of the compartment. Thus an air vent channel is formed between the foam block and the rib, running from the snout region to the lid. The cartridge 400 is an example of a single colour (black) cartridge and so only the compartment 110 is employed. However, it will be seen that one or both of the compartments 106, 108 of FIGS. 1 and 2 could equally be configured in the same manner as the compartment 110.

If air is introduced into the snout region 190 before the ink settles and would otherwise tend to trap and seal air in the bottom of the compartment, this air can be vented through to the top of the compartment alongside the rib 192 to prevent drool.

However, cartridges with such a vent rib are not suitable for being filled to high capacity. This is because when ink has filled the snout region and before it has filled the foam block, rather than filling the remainder of the foam block, it can tend to be forced up the vent channel and can simply be driven out through the top of the cartridge before the foam block has absorbed the required amount of ink.

Thus, conventional cartridges without a vent rib are useful either for low or for high capacity applications, whereas conventional cartridges with a vent rib extended from the snout region to the lid of the compartment are useful either in low or intermediate capacity applications.

This has meant that where a manufacturer wishes to produce cartridges with a full range of ink capacities, they must employ two versions of the cartridge housing. Clearly this increases production costs and it would be desirable to provide a single cartridge suitable for all ranges of ink capacity.

According to the present invention there is provided a print cartridge as claimed in claim 1.

Embodiments of the invention will now be described, by way of example, with reference to the accompanying drawings, in which:

FIG. 5 is a cross-section along the line B-B of FIG. 3 of a print cartridge 500 according to a preferred embodiment of the present invention. Again, the cartridge 500 is a black cartridge although it will be seen the invention can equally be implemented in colour cartridges where the structure now to be described is provided in all three compartments.

Figure 4:
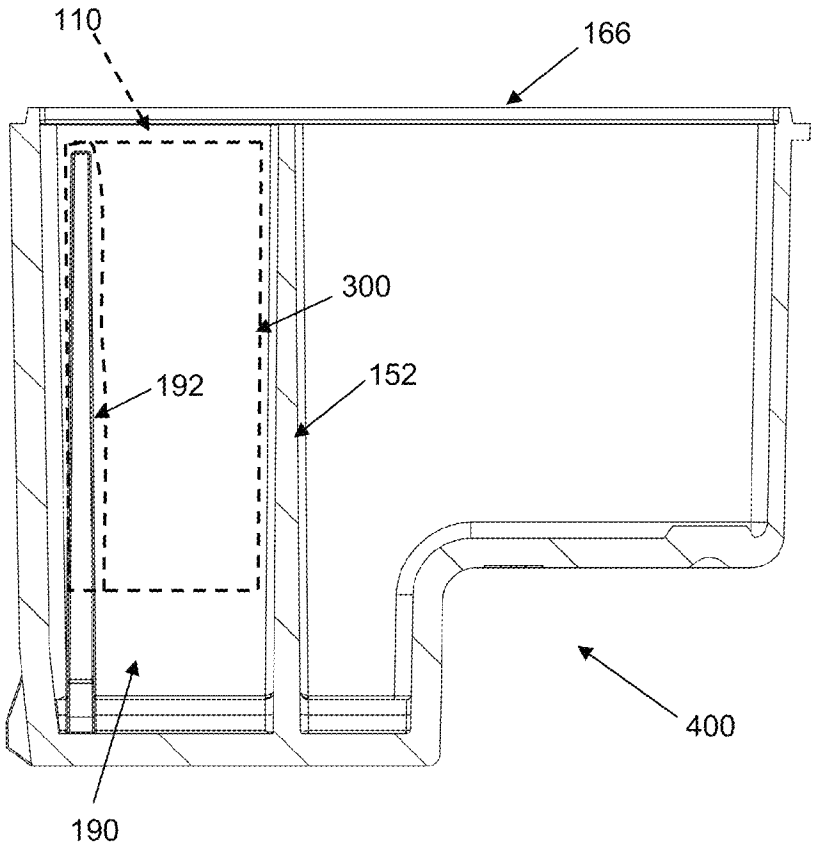
Figure 4 (Prior Art)
FIG. 4 shows a prior art variation of the print cartridge of FIG. 1, being a cross-section along the line B-B of FIG. 3.
Figure 3:
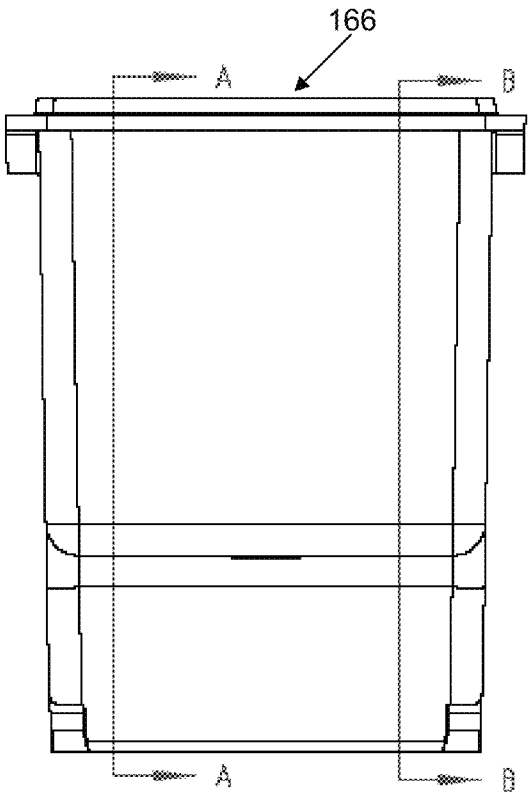
FIG. 3 is a front elevation external view of a print cartridge (the external view is the same for both the prior art cartridge of FIG. 4 as well as the embodiments of FIGS. 5 to 7)

The full height vent rib 192 of FIG. 4 has been replaced by a partial vent rib 198 extending from the snout region 190 only to a mid point of the foam block 300. An air vent channel is therefore formed along the length of the rib 198 from the snout region 190 to a point substantially below the top of the foam block. The distance between the top end of the rib 198 and the top of the foam block 300 can about 30%-70% of the height of the block. In some implementations, the distance between the top end of the rib and the top of the foam block is about 50% of the height of the block 300.

For very low and low ink capacity applications, there is no problem with venting the snout region as even when the foam block is fully charged with ink, it can be dry around its edges and so both the foam and vent ensure air cannot be trapped in the snout region.

For intermediate capacity applications, where air might otherwise have become trapped in the snout region before the ink settled to seal the snout region, the vent allows such air to escape through the vent and then through the dry foam above the vent to prevent drooling.

For high ink capacity applications, the extent of the rib is set so that when the snout region and cavity fill with ink, the foam block 300 charges with ink to the point where the ink seals the compartment above the level of the top of the partial rib. This prevents ink being able to be driven through to the top of the cartridge and then forces ink to be absorbed into the remaining foam to allow the cartridge to be fully charged with ink.

When charging is complete, the snout region is sealed with ink and so no air can be introduced into the compartment after the vacuum is withdrawn. Thus, there is no problem with drool when such cartridges are filled with either low, intermediate or high levels of ink.

Figure 5:
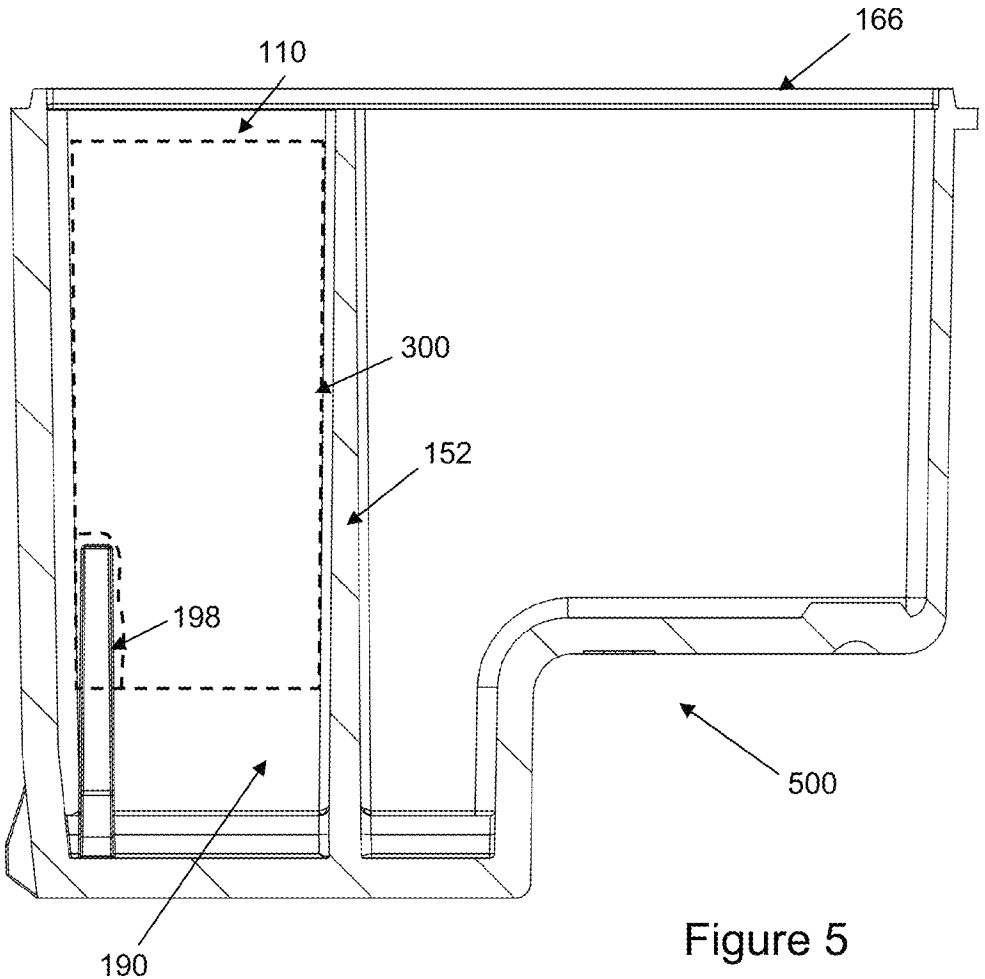
FIG. 5 shows a print cartridge according to a first embodiment of the present invention, being a cross-section along the line B-B of FIG. 3.
Figure 6:
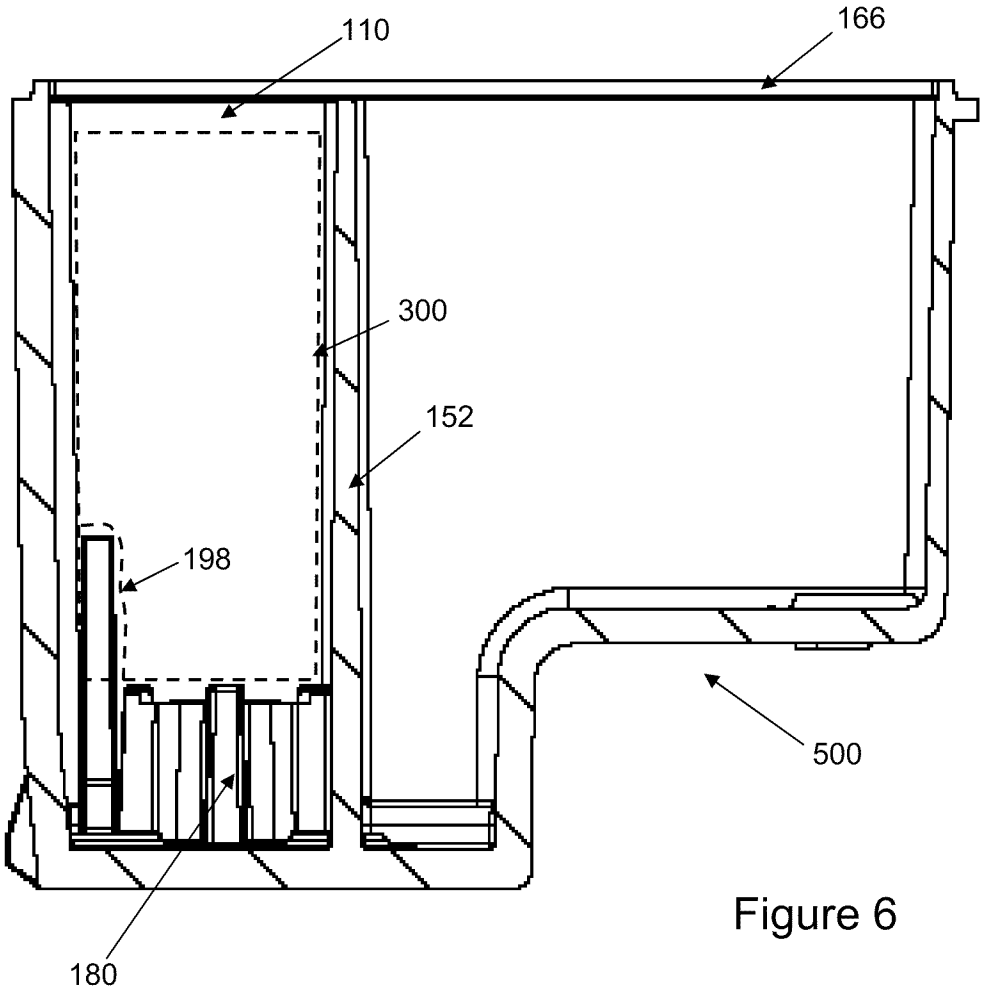
FIG. 6 shows the print cartridge of FIG. 5 in cross-section along the line A-A of FIG. 3.

In the embodiment of FIGS. 5 and 6, the rib 198 is formed on an inside surface of an external wall of the cartridge body. However, it will be seen that the invention can equally be implemented by forming the rib on any of partition walls 150, 152.

Figure 1:
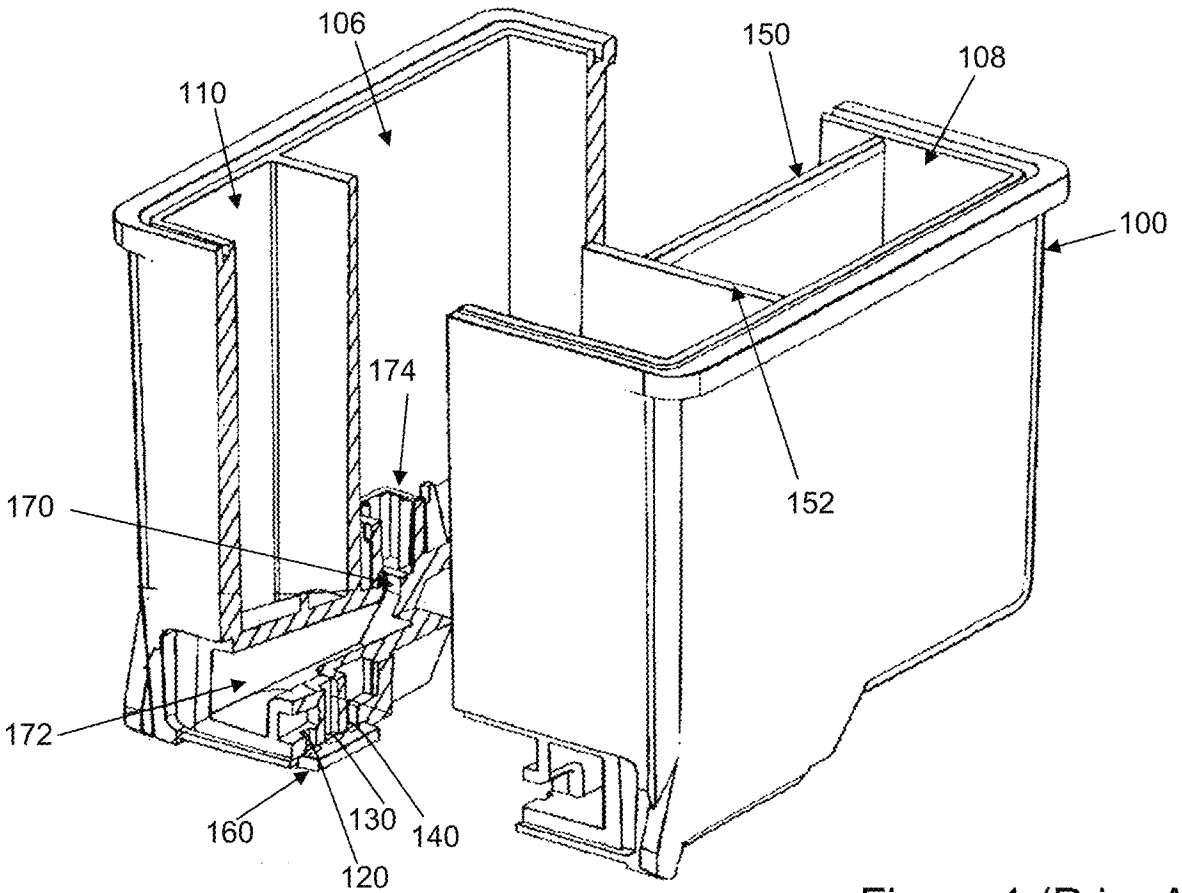
Figure 1 (Prior Art)
FIG. 1 is a perspective view of a conventional print cartridge.
Figure 2:
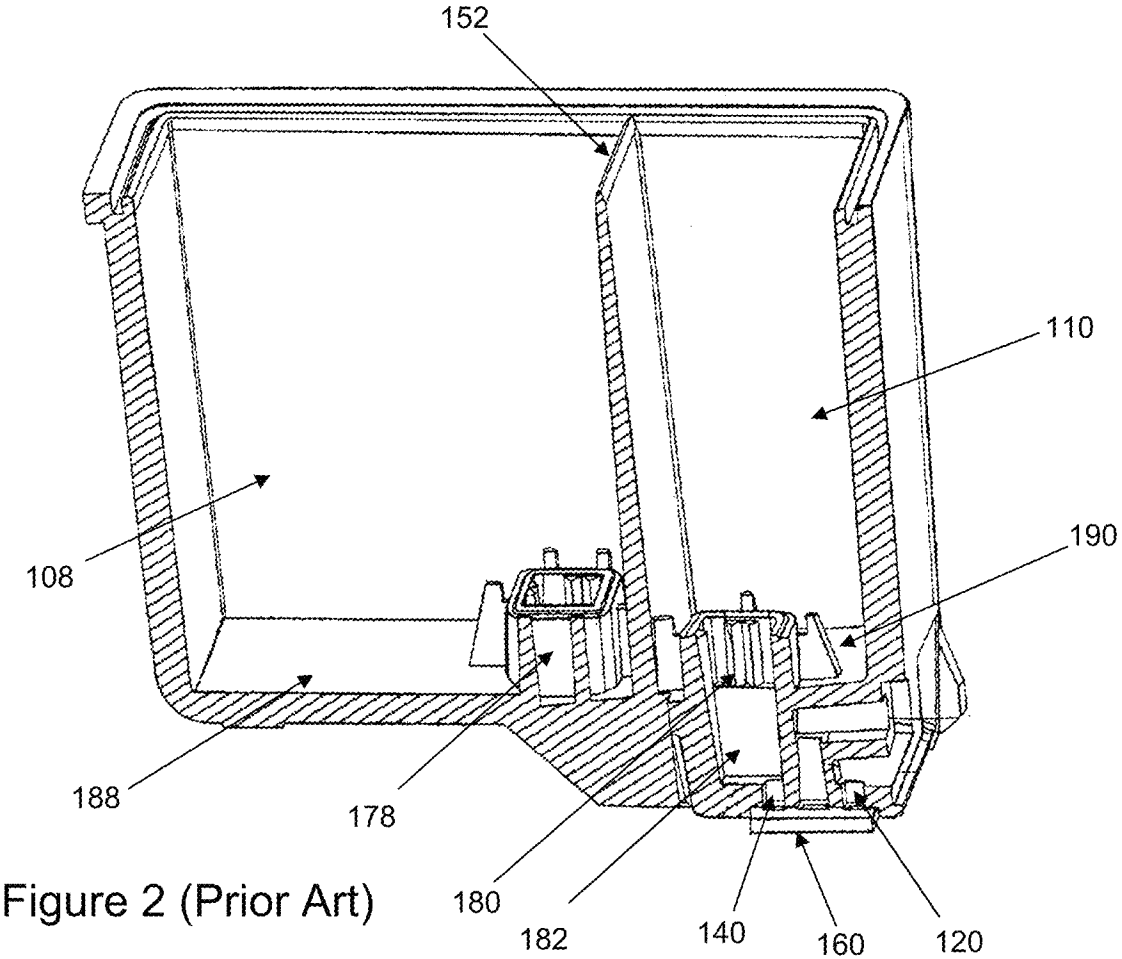
Figure 2 (Prior Art)
FIG. 2 is a perspective view of a front-to-rear section of the print cartridge of FIG. 1.
Figure 7:
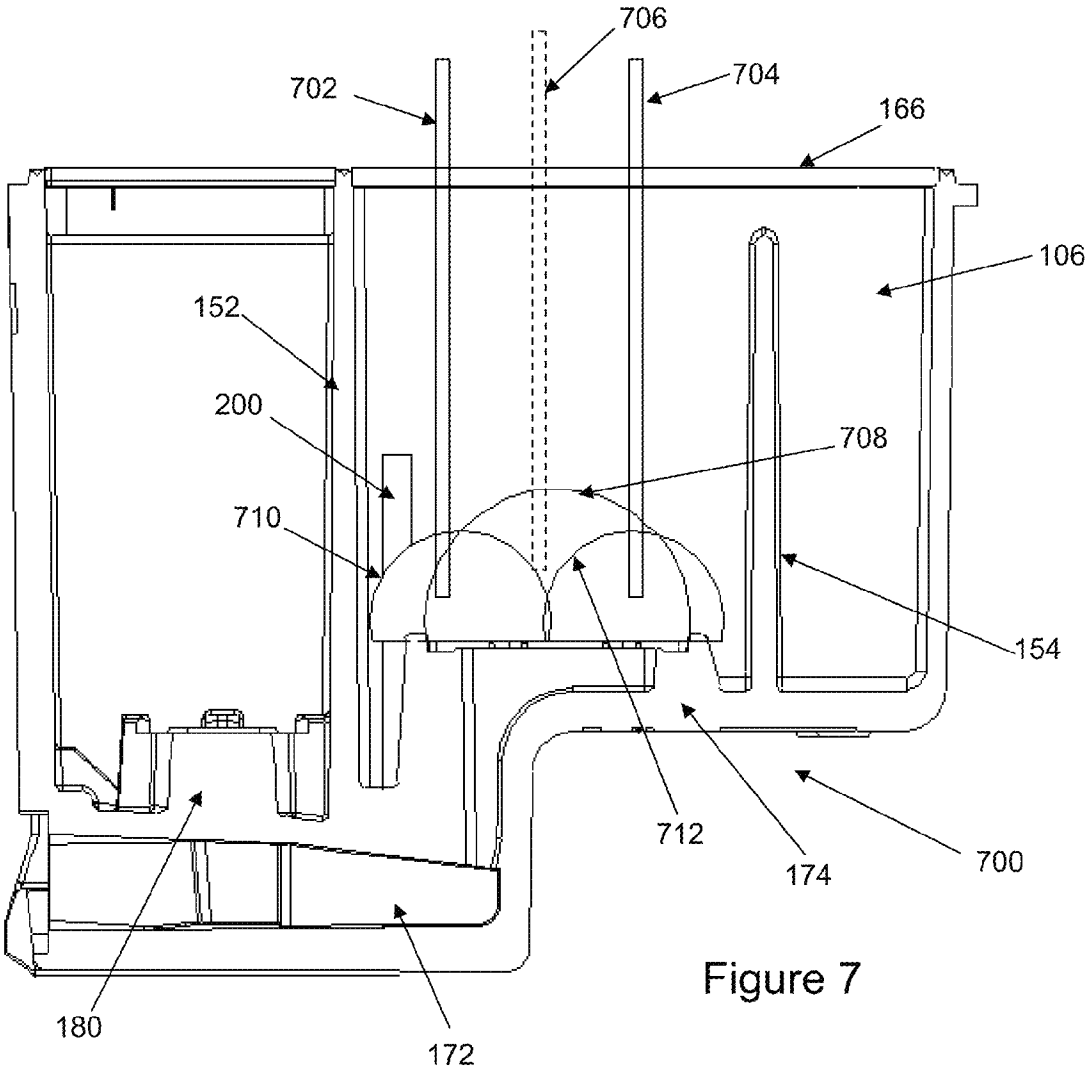
FIG. 7 shows a cross-section of a print cartridge according to a further embodiment of the present invention.

Referring now to FIG. 7, there is shown a variation 700 of the print cartridge of FIGS. 5 and 6. The cartridge 700 is a colour cartridge generally of the form of the cartridge of FIGS. 1 and 2, having 3 compartments. In this case, the compartment 106 includes an internal partition wall 154 running parallel to the wall 152 to reduce the overall volume of the compartment 106. The compartment 106 is provided with a partial vent rib 200 extending from the snout region adjacent the standpipe 174 and as such can be effectively filled with any level of ink without ink from the compartment 106 drooling.

As mentioned previously, the lid 166 includes several vent holes through which needles are passed to charge the cartridge with ink. In the case of compartments 106 and 108 of the cartridge of FIGS. 1, 2 and 7, these holes are positioned so that needles enter the compartment and locate towards the front and rear of the compartment respectively towards either side of the standpipe. FIG. 7 shows needles 702 and 704 in position within the compartment 106 and disposed towards either side of standpipe 174.

It will be seen that the snout region around the standpipe is asymmetric from the front to the rear of the cartridge. Thus, when filled from one needle, more ink will tend to be driven into the foam before charging the snout region than when filled with the other needle. Thus for lower capacity applications, needle 702 is used to charge the compartment whereas for higher capacity applications needle 704 is used to charge the compartment. For the very lowest capacity charging of the cartridge, it is desirable to charge an area of the foam just covering the upper surface of the standpipe.

Intuitively, one would expect that this would involve positioning a needle directly over the centre of the standpipe as indicated by the dashed needle position 706. However, in order to accommodate such a needle position, either the lid for the cartridge would need to be re-worked to include 3 needle holes for each of compartments 106 and 108; or a different lid would need to be employed depending on whether the cartridge was to be charged to low, intermediate or high capacity.

It will also be seen that when dispensed from the end of needle 706, ink spreads isotropically through the foam until it meets the standpipe 174. The ink then fills the cavity and continues to do so until the standpipe fills. Ink then continues to fill the foam until the surface of the standpipe is covered. At this time, the ink will have a profile generally as indicated by the line 708.

It has been found, however, that for the very lowest capacity applications, using both the needles 702 and 704 to charge the compartment results in the ink filling the foam with the dual profiles indicated by the lines 710,712. This requires less ink to charge the standpipe than using a single needle located over the standpipe as well as obviating the need to employ a new needle position to accommodate a full range of needle capacities.

The invention is not limited to the embodiment(s) described herein but can be amended or modified without departing from the scope of the present invention.

The invention claimed is:

1. A print cartridge comprising:

an ink housing having a top and a base and at least one interior compartment;

a print head mounted at the base of the housing in fluid communication with the compartment via a passageway having an entrance above the bottom of the compartment;

a compressed foam block substantially filling the compartment above the passageway entrance so as to leave a free space laterally adjacent to the passageway; and a rib extending upwardly along one wall of the compartment from the free space partially to the top of the foam block, the foam block not conforming fully to the cross-section of the rib to leave an air vent channel along at least one side of the rib between the at least one side of the rib and the foam block, wherein the rib is a non-grooved rib having a top side facing a corresponding first surface of the foam block with just air in-between and a sidewall side facing a corresponding second surface of the foam black with just the air vent channel in-between, wherein the foam block has a shape having a cut-out portion corresponding to a portion of the rib, and wherein no part of the rib is in contact with the foam block.

2. A print cartridge as claimed in claim 1, wherein the distance between the top end of the rib and the top of the foam block is about 30%-70% of the height of the block.

3. A print cartridge as claimed in claim 2, wherein the distance between the top end of the rib and the top of the foam block is about 50% of the height of the block.

4. A print cartridge as claimed in any preceding claim, wherein the foam block is hydrophobic.

5. A print cartridge as claimed in any preceding claim, wherein the compartment is closed by a cover at the top of the housing, the cover having at least one air vent.

6. A print cartridge as claimed in any preceding claim, wherein the housing has a plurality of interior compartments each in fluid communication with the print head, at least one of said compartments having a free space, foam block and rib as specified.

7. A print cartridge as claimed in claim 6, wherein each interior compartment has a respective free space, foam block and rib as specified.

8. A print cartridge as claimed in claim 1, wherein said rib extends upwardly along said wall of the compartment at least to an extent that an air vent channel is provided along said side for any air which, in the absence of said rib, would be trapped in said free space by ink supplied to said compartment settling in said compartment, and wherein said rib extends upwardly along said wall of the compartment no more than to an extent that said channel along said side can be blocked by ink supplied to said compartment to force ink to be absorbed by said foam.

9. A print cartridge comprising:

a housing having a snout region protruding from a primary region;

a top wall along the primary region;

a bottom wall along the snout region but not along the primary region;

a side end wall extending from primary region to the snout region;

a separating wall within the housing extending through both the snout region and the primary region to define an air cavity between the separating wall and the side end wall;

a foam block compressed between sidewall and the separating wall within the air cavity at a first side wall and a second side wall of the foam block such that a top of the foam block does not reach the top wall and a bottom of the foam block does not reach the bottom wall; and a rib extending from the bottom wall along a selected wall of the side end wall and the middle wall partially to the top of the foam block, the rib being non-grooved, the rib having a top side facing a corresponding horizontal surface of the foam block other than the top of the foam block with just air in-between, the rib having a side end wall facing a corresponding vertical surface of the foam block other than the first and second side walls of the foam block with just an air vent channel in-between, wherein the foam block has a shape having a cut-out portion corresponding to a portion of the rib.

* * * * *